US005105792A

United States Patent [19]

Ichikawa et al.

[11] Patent Number: 5,105,792

[45] Date of Patent: Apr. 21, 1992

[54] FUEL INJECTION SYSTEM FOR AN ENGINE

[75] Inventors: Ryuichi Ichikawa; Yu Motoyama; Takahiro Suzuki, all of Iwata, Japan

[73] Assignee: Yamaha Hatsudoki Kabushiki Kaisha, Iwata, Japan

[21] Appl. No.: 591,798

[22] Filed: Oct. 2, 1990

[30] Foreign Application Priority Data

Oct. 2, 1989 [JP] Japan ..... 1-257458

[51] Int. Cl.[5] ..... F02M 67/12

[52] U.S. Cl. ..... 123/531; 123/533

[58] Field of Search ..... 123/531, 533; 239/408, 239/416.2

[56] References Cited

U.S. PATENT DOCUMENTS

| | | | |
|---|---|---|---|
| 1,520,772 | 12/1924 | Ricardo | 123/531 |
| 4,224,904 | 9/1980 | Clerk | 123/531 |
| 4,703,740 | 11/1987 | Trapy | 123/531 |
| 4,794,902 | 1/1989 | McKay | 123/533 |

*Primary Examiner*—Tony M. Argenbright

*Attorney, Agent, or Firm*—Ernest A. Beutler

[57] ABSTRACT

An embodiment of air/fuel injection system for a two-cycle, crankcase compression, internal combustion engine wherein the air/fuel injector is provided with at least a pair of fuel injectors, one of which operates under low speed conditions and the other of which operates under high speed conditions so that adequate fuel can be injected under all running conditions before cylinder pressure reaches its maximum.

13 Claims, 5 Drawing Sheets

FUEL INJECTION SYSTEM FOR AN ENGINE

BACKGROUND OF THE INVENTION

This invention relates to a fuel injection system for an engine and more particularly to an improved air/fuel injection system.

It is known that the performance of many engines can be improved by employing fuel injection systems and particularly direct fuel injection systems. For example, it has been found that the efficiency and emission control of a crankcase compression, two-cycle engine can be improved if direct cylinder fuel injection is employed. However, the use of such direct injected systems gives rise to certain problems.

For example, during the engine operation, there is a wide variance of speed and load ranges under which the engine must operate. This is particularly true when the engine is employed as a power plant for a vehicle. To provide a fuel injection system for an engine wherein all of the fuel supply requirements can be supplied and accurately controlled can be extremely expensive. That is, if a single fuel injector is employed for providing all of the fuel requirements of the engine regardless of its operating condition, very expensive injectors and control systems may be required.

It is, therefore, a principal object of this invention to provide an improved fuel injection system for an internal combustion engine.

It is a further object of this invention to provide an injection system for an internal combustion engine that will adequately supply and control the fuel requirements under all running conditions and yet which will be low in cost.

The type of fuel injectors that inject not only fuel but air under pressure into the combustion chamber have been known for a long period of time. Under certain applications, such air and fuel injection may be desirable. However, the use of an injector that injects both air and fuel provides a more complicated and bulky system. It has been found that the range of fuel control for the engine can be improved if a pair of fuel injectors are employed for meeting the maximum fuel requirements and also providing accurate control under low speed conditions. However, when two fuel injectors are employed and an air fuel injection system is incorporated, the system can be extremely bulky and difficult to incorporate into an engine.

It is, therefore, a still further object of this invention to provide an improved air/fuel injector for an internal combustion engine which has a simple compact construction.

In conjunction with direct cylinder injection, the pressure of the fuel that is discharged into the combustion chamber must, of course, be greater than the pressure that is existent within the combustion chamber. That is, the amount of fuel sprayed will be dependent to some extent on the pressure difference between the pressure discharged from the injector and the pressure in the combustion chamber. However, as the piston approaches top dead center, the compression pressure in the cylinder will rise abruptly and it is therefore desirable to complete the fuel injection before the pressure rises significantly. This is particularly important in conjunction with air/fuel injectors wherein the air pressure may be relatively limited in relation to actual compression pressures. Of course, there is a practical limit in the time at which injection can be started and, therefore, the actual time interval during which fuel injection can be accomplished in the cylinder is somewhat limited with respect to crank angle.

It is, therefore, a further object of this invention to provide a fuel injector that will insure that adequate fuel can be injected into the engine before the compression pressure becomes too high.

It is a further object of this invention to provide an improved fuel injector of the air/fuel type wherein the amount of fuel injected before compression pressure becomes too high can be substantial under high speed running conditions without losing control at low speed conditions.

SUMMARY OF THE INVENTION

This invention is adapted to be embodied in an air/fuel injector for an internal combustion engine that comprises a housing assembly defining a nozzle. An injector valve is incorporated for opening and closing the nozzle for communicating the injector with an engine chamber. A pair of fuel injectors each adapted to spray fuel into the housing assembly for discharge from the nozzle when the injector valve is opened are provided. A compressed air source for supplying compressed air to the housing assembly for delivery when the injection valve is opened is also provided. Means are provided for operating the fuel injectors so that one of the fuel injectors delivers fuel to the housing assembly at at least one running condition and the other of the fuel injectors supplies fuel to the housing assembly at at least another running condition.

DETAILED DESCRIPTION OF THE PREFERRED EMBODIMENT

Figure 1:
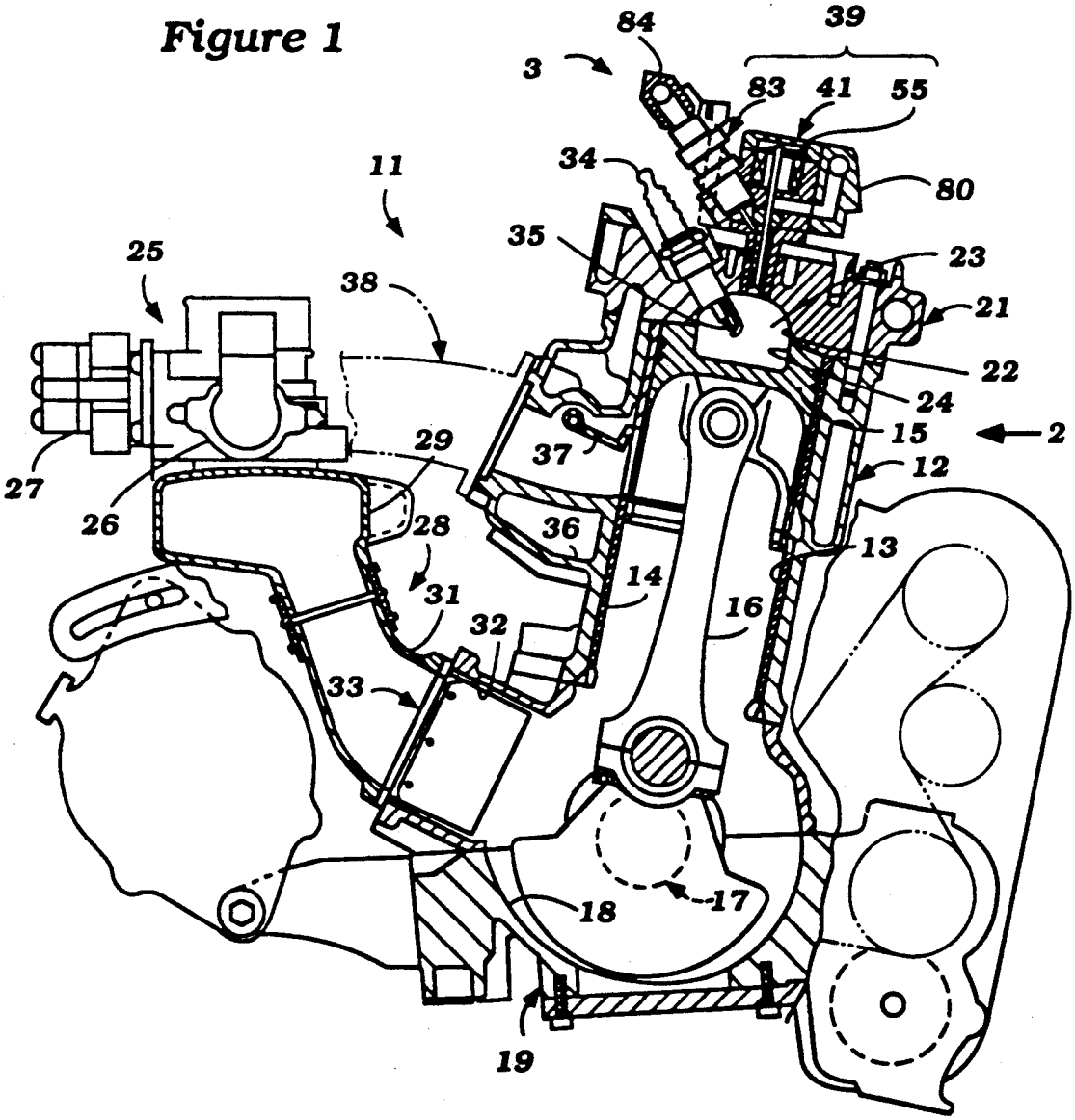
FIG. 1 is a cross-sectional view taken through one cylinder of a multiple cylinder, two-cycle, crankcase compression engine constructed in accordance with an embodiment of the invention.
Figure 2:
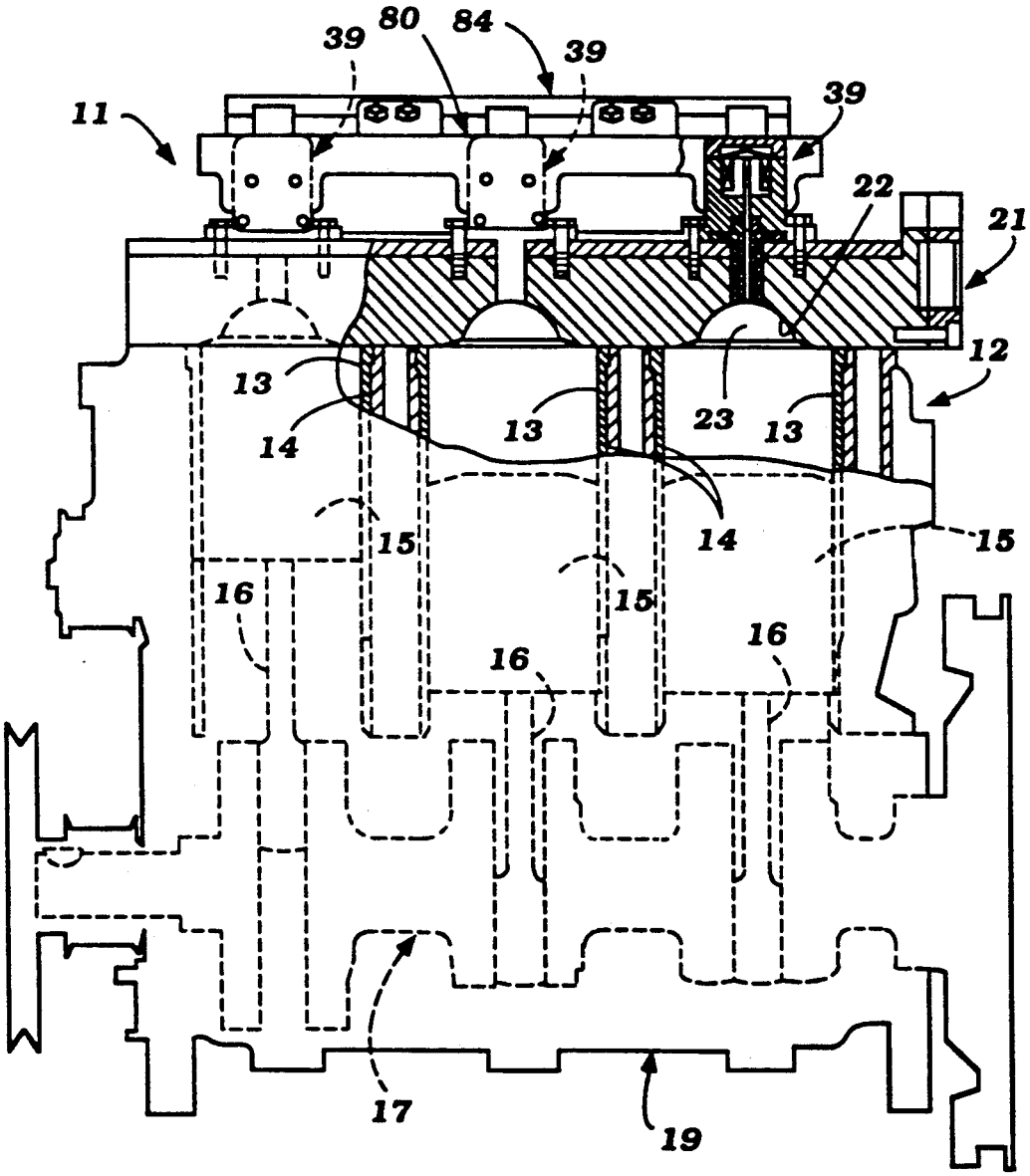
FIG. 2 is a side elevational view, with portions broken away, of the engine and looking generally in the direction of the arrow 2 in FIG. 1.
Figure 3:
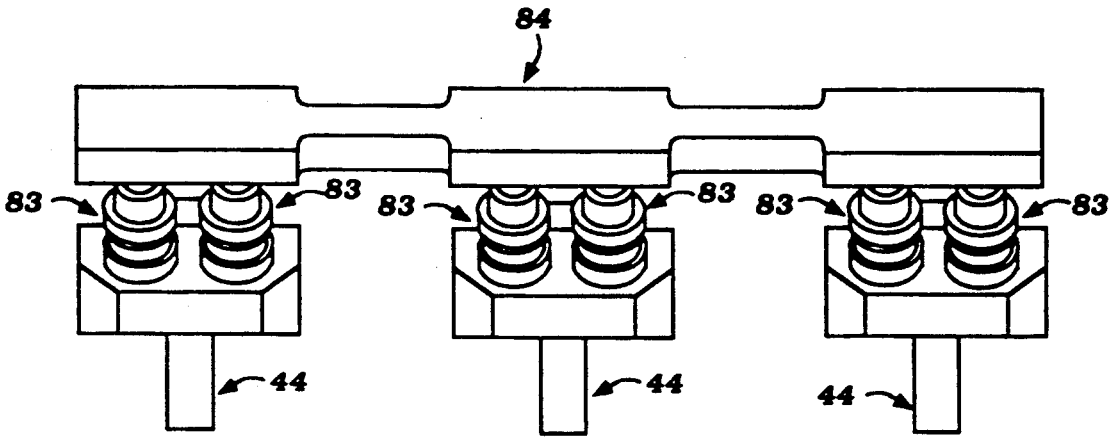
FIG. 3 is an enlarged view of the fuel injector portion of the system and is taken generally in the direction of the arrow 3 in FIG. 1.
Figure 6:
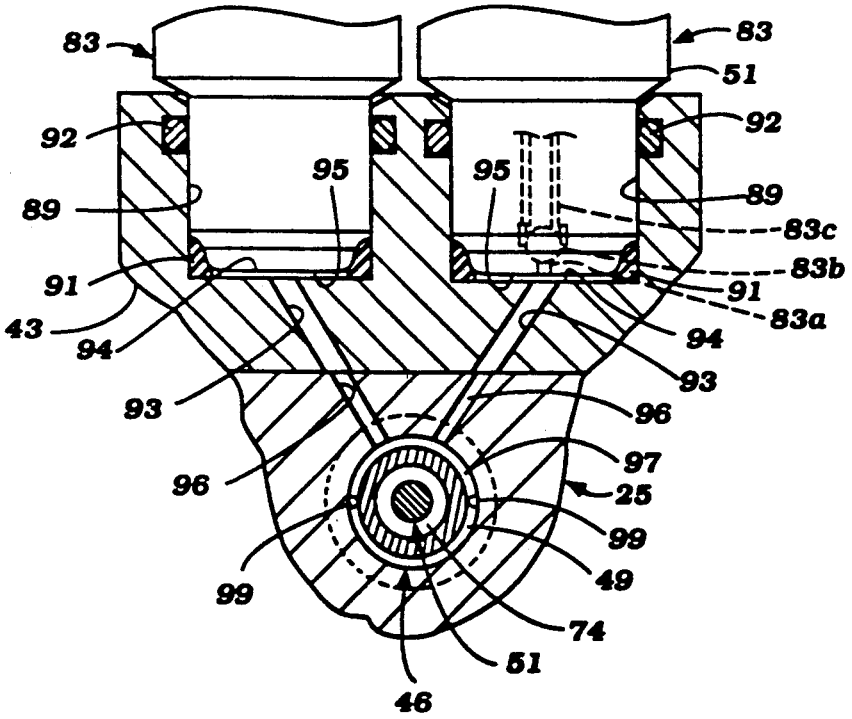
FIG. 6 is a cross-sectional view taken generally along the line 6—6 of FIG. 4.

Referring now in detail to the drawings and initially primarily to FIGS. 1 and 2, a three cylinder, inline, two-cycle, crankcase compression, internal combustion engine constructed in accordance with an embodiment of the invention is identified generally by the reference numeral 11. The engine 11 is, as noted, illustrated to be a three cylinder, inline type engine. It is to be understood, however, that the invention may be also employed in conjunction with engines having other numbers of cylinders and other cylinder orientations. In fact, certain features of the invention can be utilized in conjunction with rotary rather than reciprocating type engines and, in addition, some features of the invention may also be employed in engines operating on the fourstroke rather than two-stroke principle. The invention, however, has particular utility in conjunction with two-stroke engines.

The engine 11 is comprised of a cylinder block assembly, indicated generally by the reference numeral 12, in which three aligned cylinder bores 13 are formed by cylinder liner 14 that are received within the cylinder block 12 in a known manner. Pistons 15 are supported for reciprocation within each of the cylinder bores 14 and are connected by means of respective connecting rods 16 to a crankshaft 17 that is journaled for rotation within a crankcase chamber 18 formed by the cylinder block 12 and a crankcase 19 in a known manner.

A cylinder head assembly 21 is affixed to the cylinder block 12 and has individual recesses 22 which cooperate with the piston 15 and cylinder bore 13 to form combustion chambers 23. The heads of the pistons 15 are provided with bowls 24 so as to further form these combustion chambers 23.

An air charge is delivered to the crankcase chambers 18 associated with each of the cylinder bores 13 by an induction system that includes a throttle body, indicated generally by the reference numeral 25, that receives air from an air cleaner (not shown). This throttle body 25 includes a throttle valve (not shown) which is manually operated and the position of which is sensed by a potentiometer 26 to provide a throttle valve position signal for controlling the fuel injection system to be described. In addition, a sub-injector 27 may be provided in the throttle body 25 so as to inject additional fuel under certain running conditions.

The throttle body 25 delivers the air to an induction system, indicated generally by the reference numeral 28, and which includes a plenum chamber 29. The plenum chamber supplies air through manifolds 31 to inlet ports 32 associated with each crankcase chamber 18. These crankcase chambers 18 are sealed from each other, as is typical with two-cycle engine practice. A reed type throttle valve 33 is positioned in each inlet port 32 so as to prevent reverse flow when the charge is being compressed in the crankcase chambers 18 by downward movement of the pistons 15.

The compressed charge is transferred to the combustion chambers 23 through suitable scavenge passages (not shown). This charge is then further compressed in the combustion chambers 23 by the upward movement of the pistons 15 and is fired by a spark plug 34 mounted in the cylinder head 21 with its gap 35 extending into the combustion chamber 23.

The burnt charge is then discharged from the combustion chambers 23 through exhaust ports 36 in which exhaust control valves 37 are provided. The exhaust control valves 37 are operated so as to provide a reduced compression ratio under high speed, high load operating conditions in a suitable manner. The exhaust gases are then discharged to the atmosphere through an exhaust system which includes an exhaust manifold 38.

The fuel charge for the combustion and an additional air charge is supplied by injector units 39 which are shown in most detail in the remaining figures and will now be described by reference additional to these remaining figures.

The injectors 39 include a housing assembly, indicated generally by the reference numeral 41, which is comprised of a lower housing piece 42 and an upper housing piece 43. The lower housing piece 42 has a cylindrical portion 44 that is received within a suitable bore formed in the cylinder head and terminates at a nozzle portion 45. The nozzle pordstion 45 is formed by an insert, indicated generally by the reference numeral 46, which has a cylindrical portion 47 that is disposed radially inwardly of a bore 48 formed in the cylindrical portion 44 of the lower housing portion piece 42. This forms a chamber 49 to which fuel is delivered, in a manner to be described. The nozzle opening 45 is formed by an enlarged diameter portion of the insert 46.

An injection valve, indicated generally by the reference numeral 51, has a head portion 52 that cooperates with the nozzle seat 45 so as to open and close it. The injection valve 51 has a reduced diameter portion 53 that extends through a bore in the insert piece 46 and which is connected at its upper end to an armature plate 54 of a solenoid assembly, indicated generally by the reference numeral 55. The upper end of the valve stem 53 is threaded as at 56 so as to receive a nut 57 to provide an adjustable connection to the armature plate 54.

A coil compression spring 58 acts against the armature plate 54 and urges the injection valve 51 to its normal closed position as shown in the figures of the drawing. A solenoid winding 59 encircles the upper end of the valve stem 53 and when energized will attract the armature plate 54 downwardly to compress the spring 58 and open the injection valve 51.

The valve stem 51 is provided with upper and lower extension lugs 61 and 62 that slidably engage the bore in the insert piece 46 so as to support the valve 51 for its reciprocal movement without interfering with the air flow therepast.

The cylindrical portion 44 of the housing piece 42 is formed with one or more annular grooves in which an O-ring seal 63 is provided for sealing with the cylinder head. In a like manner, its internal surface is formed with an annular groove so as to receive an O-ring seal 64 which seals with the enlarged end of the insert 46.

The housing piece 42 has an enlarged flange 65 formed at its upper end which is received within a counterbore formed in the lower face of the housing piece 43. Socket headed screws 66 affixed the housing pieces 42 and 43 to each other and an O-ring seal 67 provides a seal between these pieces. The insert piece 46 has an enlarged headed portion 68 that is received within a bore formed in the housing piece 43 at the base of the counterbore which receives the flange 65 of the housing piece 42. Above this bore, the housing piece 43 is provided with a further bore that receives a sleeve 69 that is threaded to the core of the solenoid winding 59 and against which the coil compression spring 58 bears. This sleeve 69 provides a combined mounting function for the winding 59 and preload adjustment for the spring 58. The sleeve 69 is held in position by means of a lock screw 71 which is threaded through the housing piece 43 and which is accessible through an opening 72 formed in the side thereof. The opening 72 also admits air, in a manner to be described, which can flow through a slotted opening 73 in the sleeve 69 so as to be received in a gap 74 formed around the valve stem 53 and the interior of the insert piece 46.

The air is delivered to the opening 72 from an air manifold, indicated generally by the reference numeral 74, and which is affixed to the injector bodies in a suitable manner. The air manifold 80 has a transversely extending passage 75, one end of which is connected to a regulated source of air pressure (not shown). The bore 75 is intersected by crossbores 76, the outer ends of which are closed by plugs 77. The manifold 80 is further provided with intersecting passages 78 which communicate with the openings 72 in the housing piece 43 so as to permit air under pressure to enter the aforenoted chamber 74.

Air leakage from around the solenoid 55 is precluded by means of a cap 81 that is affixed to the upper end of the housing piece 43 and which engages an O-ring seal 82.

Figure 4:
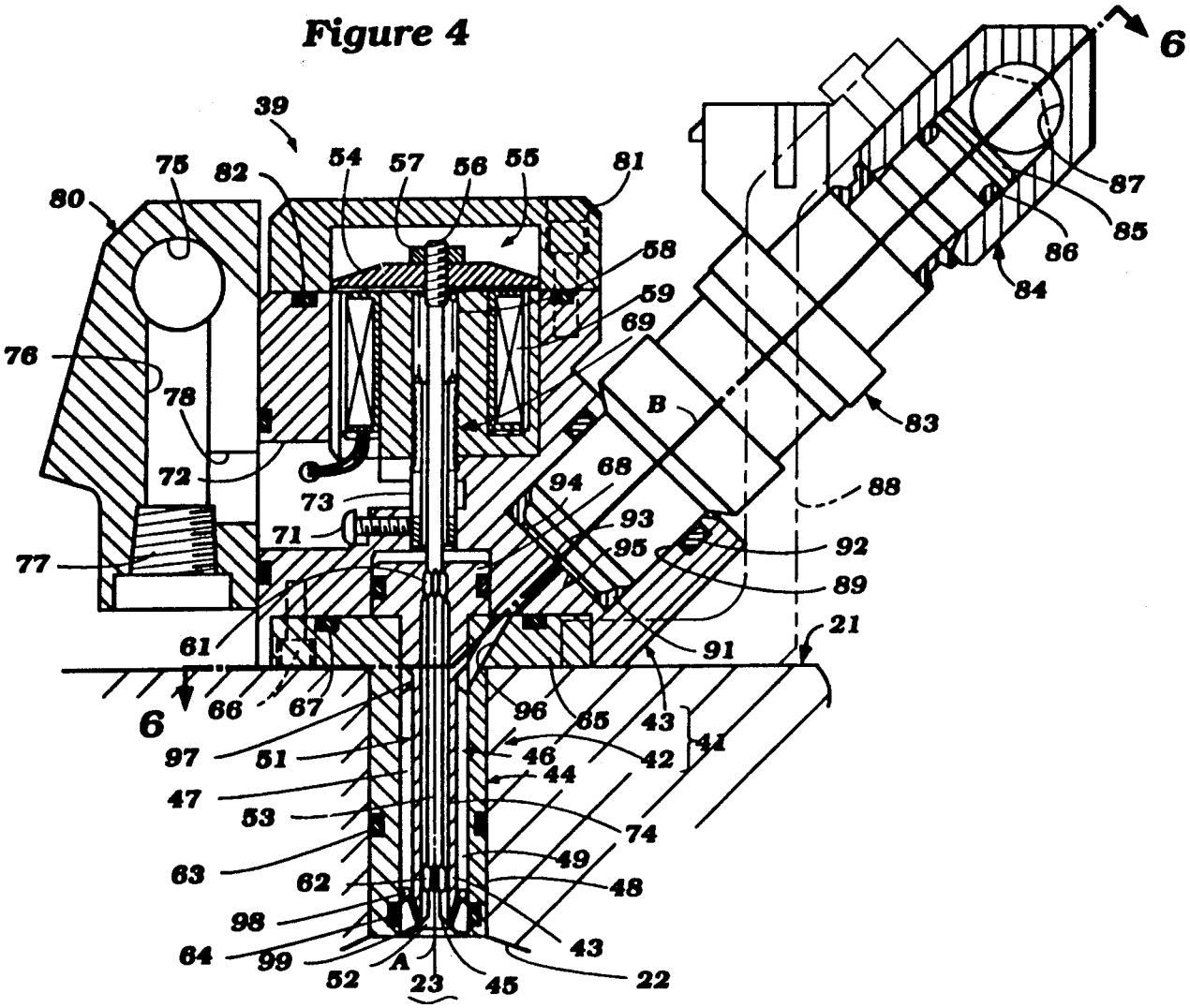
FIG. 4 is a cross-sectional view taken through one of the injectors on the same plane as FIG. 1 but looking in the opposite direction.
Figure 5:
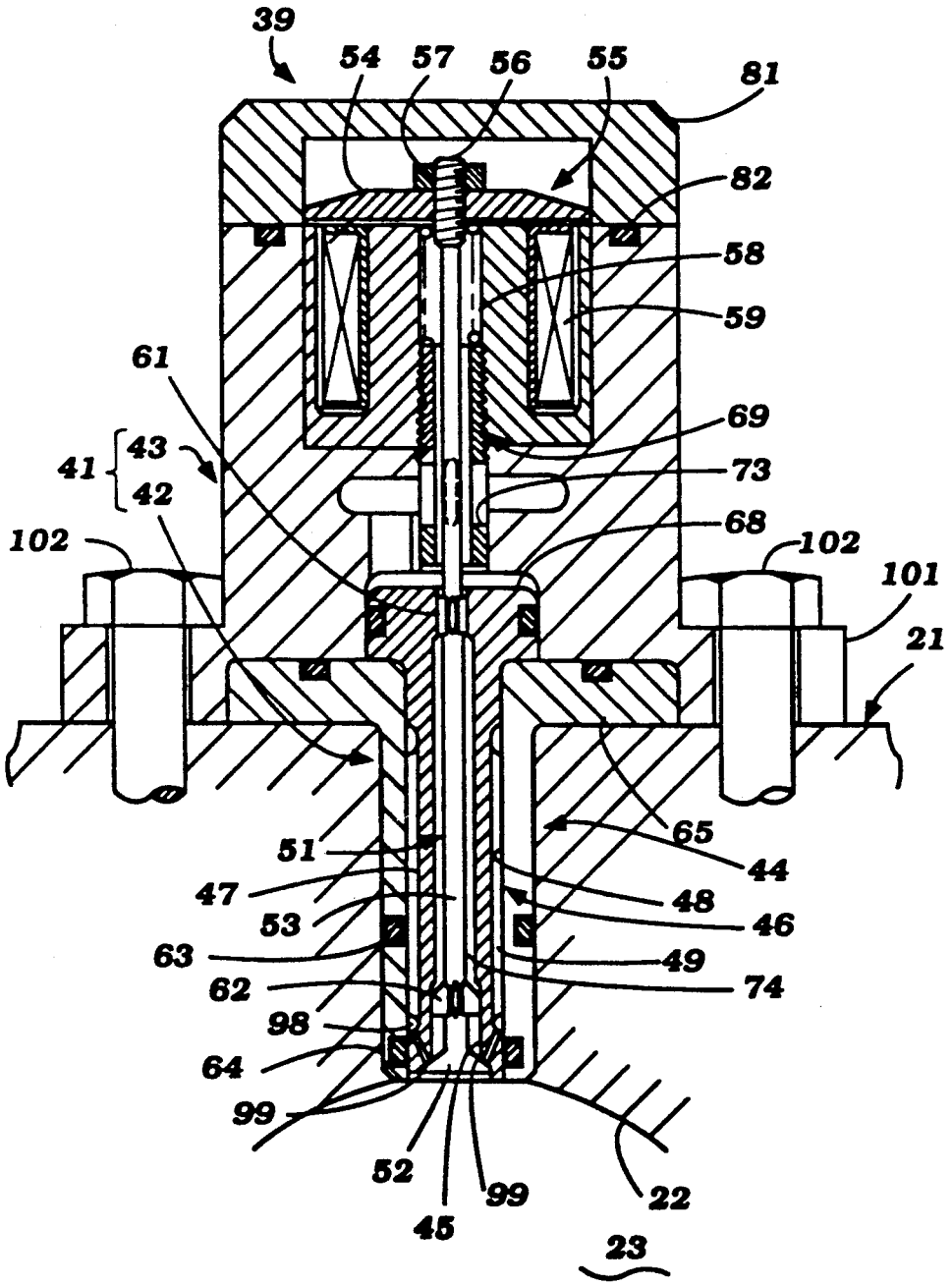
FIG. 5 is a cross-sectional view taken along a plane perpendicular to the plane of FIG. 4.

In accordance with a feature of the invention, a plurality of fuel injectors 83 are provided for each of the injectors 39. In the illustrated embodiment, two such fuel injectors 83 are provided for each injector assembly 39. The fuel injectors 83 may be of any known type and include a nozzle opening 83*a*, a delivery valve 83*b* and a valve actuator 83*c*. Fuel is delivered to all of the fuel injectors 83 by a fuel manifold 84 that is affixed to the tips 85 (FIG. 4) of the fuel injectors 83 and which are sealed thereto by O-ring seals 86. A manifold line 87 which communicates with a regulated pressure fuel source (not shown) delivers the fuel to the fuel injectors 83. The fuel manifold 84 is mounted on a mounting bracket that is shown in phantom in FIG. 4 and which is identified by the reference numeral 88.

For ease of location, the housing piece 43 is formed with a pair of bores 89 that are disposed at approximately a 45 degree angle as shown by the line B to the axis A of the injector valve 51. These bores 89 receive the nozzle portions of the injectors 83. O-ring seals 91 and 92 provide a sealing function around these nozzle portions so that the fuel which issues from the injectors 83 will be directed toward passages 93 that are bored into the housing piece 43. These passages extend from the bores 89 and specifically from shoulders 94 formed at the base of these bores 89. The fuel injector nozzle end portions 95 are spaced slightly from the end walls 94 so as to provide a chamber through which the fuel will be injected.

The housing piece passages 93 are intersected by corresponding passages 96 formed in the housing piece 42. These passages terminate in an annular recess 97 formed in the periphery of the insert 46 so as to communicate the fuel with the chamber 49. At the lower end of the chamber 49, there is provide another annular relief 98 that is intersected by a plurality of ports 99 that extend through the lower end of the enlargement of the insert piece 46 at the valve seat 45. Hence, when the valve head 52 moves to its open position, both fuel and air will be valved into the combustion chambers 23.

The timing of opening and closing of the injection valve 51 in response to crank angle can be suitably selected as desired. However, it is desirable if the completion of injection can be accomplished before the pressure in the combustion chambers 23 becomes too high, as aforenoted. To assure that this is possible and all the necessary fuel can be injected, the injectors 83 are operated on a sequence so that only one injector supplies fuel under low and mid-range performance. However, under high load and high speed conditions, both injectors are operated so that adequate fuel can be charged into the chamber 49 and discharged when the injection valve is opened regardless of the other strategies of the timing of fuel and air injection. Also, the positioning of the injectors 83 as aforedescribed is such that the injectors can be easily mounted and yet there will be insured good mixing of the fuel and air when they are delivered to the combustion chambers 23.

The housing piece 43 is provided with a flange portion 101 that receives threaded fasteners 102 so as to affix the injectors 39 to the cylinder head 21.

It should be readily apparent from the foregoing description that the described injector assembly and operation permits a very compact assembly and, at the same time, permits adequate fuel charging under all conditions while maintaining relatively low injection pressures since the injector valve 51 will be closed before the combustion chamber pressure becomes too high. It is to be understood, of course, that the foregoing description is that of a preferred embodiment of the invention and that various changes and modifications may be made without departing from the spirit and scope of the invention, as defined by the appended claims.

We claim:

1. An air/fuel injector for an internal combustion engine comprising a housing assembly defining a nozzle, an injector valve for opening and closing said nozzle, a pair of fuel injectors each adapted to spray fuel into said housing assembly for discharge from said nozzle when said injector valve is opened, a compressed air source for supplying compressed air to said housing assembly for discharge when said injector valve is opened, and means for operating said fuel injectors so that one of said, fuel injectors delivers fuel to said housing assembly only at at least certain running conditions and the other of said fuel injectors supplies fuel to said housing at at least another running condition.

2. An air/fuel injector as set forth in claim 1 wherein the other fuel injector supplies fuel to the housing assembly under all running conditions.

3. An air/fuel injector as set forth in claim 2 wherein the one fuel injector supplies fuel to the housing assembly only under high speed running conditions.

4. An air/fuel injector as set forth in claim 1 wherein the housing assembly defines a chamber to which fuel is injected by the fuel injectors and which chamber communicates with the combustion chamber when the injector valve is opened.

5. An air/fuel injector as set forth in claim 4 wherein the fuel injectors inject fuel to the chamber at contiguous locations.

6. An air/fuel injector as set forth in claim 5 wherein the fuel injectors are disposed at an acute angle to the axis of the injector valve and wherein the fuel injectors are disposed in parallel relationship to each other.

7. An air/fuel injector as set forth in claim 6 wherein the compressed air is supplied to another chamber of the housing assembly.

8. An air/fuel injector as set forth in claim 1 wherein the housing assembly defines a first chamber into which the fuel injectors discharge and a second chamber to which the compressed air is supplied.

9. An air/fuel injector as set forth in claim 8 wherein both of the chambers are valved by a common injection valve.

10. An air/fuel injector for an internal combustion engine comprising a housing assembly defining a nozzle, an injector valve for opening and closing said nozzle, a pair of fuel injectors each adapted to spray fuel into said housing assembly for discharge from said nozzle when said injector valve is opened, a compressed air source for supplying compressed air to said housing assembly for discharge when said injector valve is opened, said housing assembly defining a first chamber into which said fuel injectors discharge and a second chamber to which the compressed air is supplied, and means for operating said fuel injectors so that one of said fuel injectors delivers fuel to said housing assembly at at least one running condition and the other of said fuel injectors supplies fuel to said housing at at least another running condition.

11. An air/fuel injector as set forth in claim 10 wherein both of the chambers are valved by a common injection valve.

12. An air/fuel injector for an internal combustion engine comprising a housing assembly defining a nozzle, an injector valve moveable along an axis for opening and closing said nozzle, a pair of fuel injectors each adapted to spray fuel into a chamber formed in said housing assembly for discharge from said nozzle into a combustion chamber when said injector valve is opened, said fuel injectors being disposed at an acute angle to said axis of said injector valve and wherein said fuel injectors are disposed in parallel relationship to each other, a compressed air source for supplying compressed air to said housing assembly for discharge when said injector valve is opening, and means for operating said fuel injectors so that one of said fuel injectors delivers fuel to said housing assembly at at least one running condition and the other of said fuel injectors supplies fuel to said housing at at least another running condition.

13. An air/fuel injector as set forth in claim 12 wherein the compressed air is supplied to another chamber of the housing assembly.

* * * * *